US005266927A

United States Patent [19]

Sanders

[11] Patent Number: 5,266,927

[45] Date of Patent: Nov. 30, 1993

[54] PERSONAL PROTECTION DEVICE

[75] Inventor: James L. Sanders, Omaha, Nebr.

[73] Assignee: Board of Regents of the University of Nebraska, Lincoln, Nebr.

[21] Appl. No.: 769,413

[22] Filed: Oct. 1, 1991

[51] Int. Cl.[5] ..... G08B 15/00; G08B 21/00

[52] U.S. Cl. ..... 340/574; 340/573; 340/693

[58] Field of Search ..... 340/574, 573, 693

[56] References Cited

U.S. PATENT DOCUMENTS 4,520,351 5/1985 Altman et al. ..... 340/574

*Primary Examiner*—Glen R. Swann, III

[57] ABSTRACT

A personal protection device includes a generally dumbbell shaped hollow housing with an operable lever mounted in the central portion of the housing. An electrical circuit within the housing connects first and second switches to a power source and a speaker to produce a high decibel sound when both switches are closed. The first switch is connected to the lever and is maintained in an open position by gripping the housing and lever. The second switch is operable to the open position only upon operating a numeric code or other key lock system. Once the key lock switch has been closed, the speaker will be activated upon release of the lever on the dumbbell. A relay in the electrical circuit will bypass the first switch connected to the lever, once the relay has been activated, so that the speaker cannot be turned off except by opening the lockable second switch.

6 Claims, 2 Drawing Sheets

PERSONAL PROTECTION DEVICE

TECHNICAL FIELD

The present invention relates generally to audible alarms, and more particularly to an improved hand held alarm which will be triggered upon release of the apparatus from the hand.

BACKGROUND OF THE INVENTION

While jogging and similar exercise has become a popular trend, unfortunately, it is typically necessary for the jogger to carry devices for personal protection. While many such devices are available, they suffer several drawbacks.

One protection device available is mace or similar spray chemical. However, it is necessary for the jogger to obtain the mace container from a purse or other location where it is carried, and directed at the attacker. Obviously, if the attacker surprises the jogger, there is no time to perform these two steps. Further, the attacker could knock the can of chemical from the joggers hand, rendering the protection device useless.

Loud piercing alarms or whistles are also a common protection device. In the case of an alarm, the jogger must typically throw a switch to turn on the alarm. If the device is removed from the jogger's hand, the attacker can easily turn the switch off to negate the effect of the alarm. Again, if the attacker surprises the jogger, the jogger is not always able to activate the switch to trigger the alarm.

It is therefore a general object of the present invention to provide an improved personal protection device.

Another object is to provide a personal protection device which is activated upon release from the jogger's hand.

Yet another object of the present invention is to provide a personal protection device which, once activated, can only be deactivated by operating a second switch.

Yet another object is to provide a personal protection device which is formed in a shape which may be easily carried in the hand while jogging.

Still another object of the present invention is to provide a personal protection device which is simple to manufacture, easy to use and refined in appearance.

These and other objects will be apparent to those skilled in the art.

SUMMARY OF THE INVENTION

The personal protection device of the present invention includes a generally dumbbell shaped hollow housing with an operable lever mounted in the central portion of the housing. An electrical circuit within the housing connects first and second switches to a power source and a speaker to produce a high decibel sound when both switches are closed. The first switch is connected to the lever and is maintained in an open position by gripping the housing and lever. The second switch is operable to the open position only upon operating a numeric code or other key lock system. Once the key lock switch has been closed, the speaker will be activated upon release of the lever on the dumbbell. A relay in the electrical circuit will bypass the first switch connected to the lever, once the relay has been activated, so that the speaker cannot be turned off except by opening the lockable second switch.

DESCRIPTION OF THE PREFERRED EMBODIMENT

Figure 1:
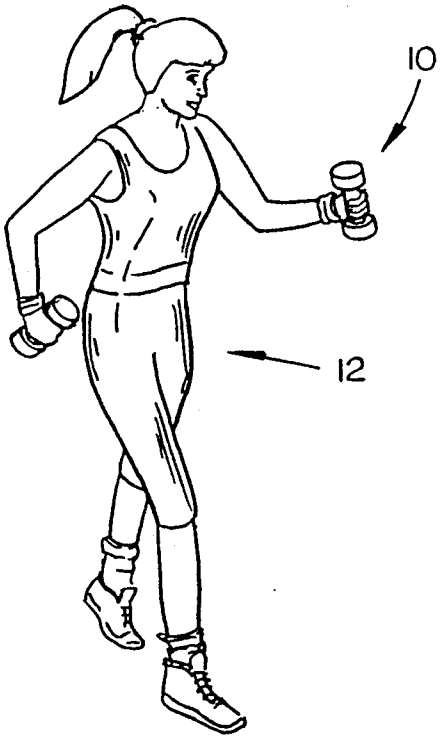
FIG. 1 is a pictorial view of a jogger carrying the personal protection device of the present invention.

Referring now to the drawings, in which similar or corresponding parts are identified with the same reference numeral, and more particularly to FIG. 1, the personal protection device of the present invention is designated generally at 10 and is formed in the shape of a dumbbell, to be easily carried by a jogger 12.

Figure 2:
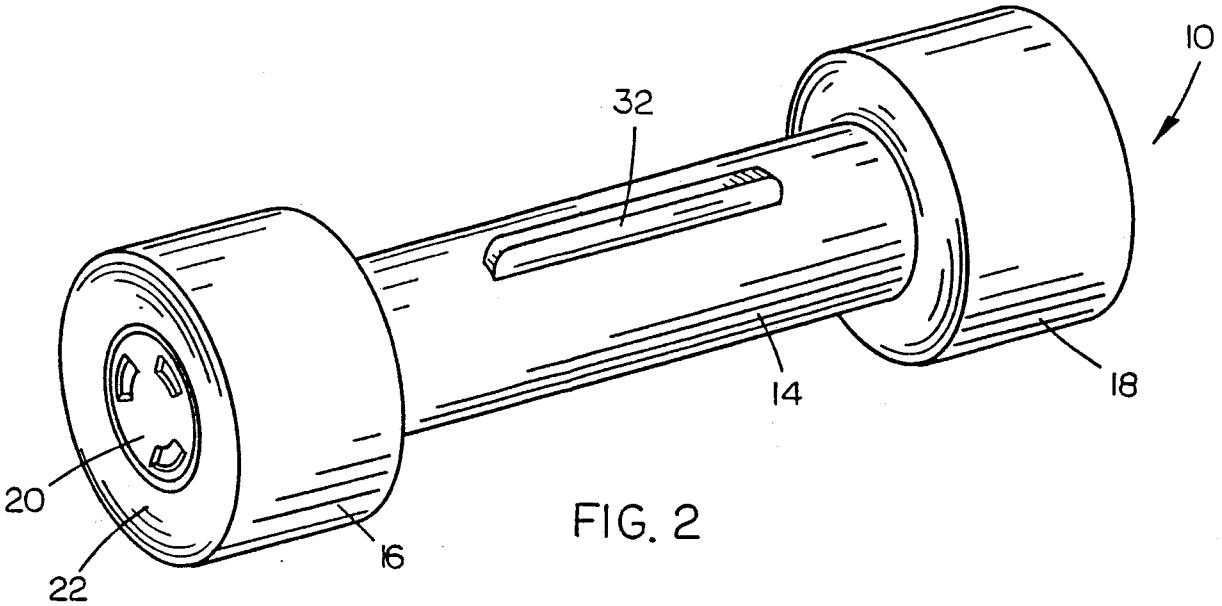
FIG. 2 is a pictorial view of the invention.
Figure 5:
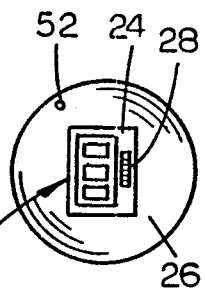
FIG. 5 is an end view of the invention taken from the right end of FIG. 2.
Figure 4:
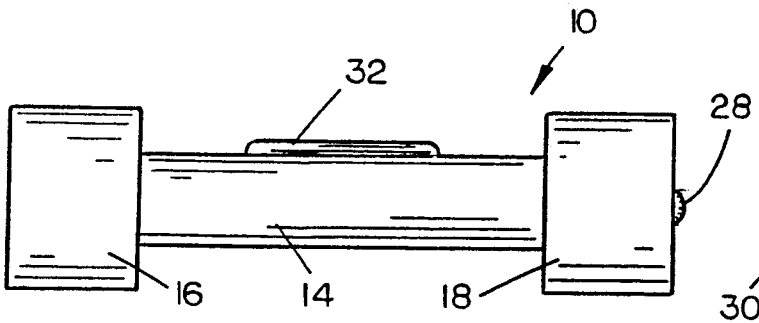
FIG. 4 is a side elevational view of the invention.
Figure 3:
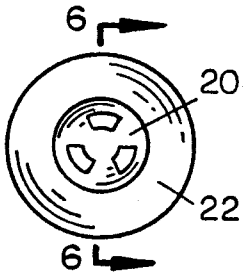
FIG. 3 is an end view of the invention taken from the left end of FIG. 2.

Referring now to FIGS. 2–5, personal protection device 10 includes a central cylindrical arm 14 with an enlarged cylindrical end 16 and an enlarged cylindrical second end 18 to form a general dumbbell shape. First end 16 has a speaker 20 mounted therein flush with the outer end face 22 of first end 16. Speaker 20 will produce a high decibel audible alarm when device 10 is triggered. When a digital switch 24 is mounted in second end 18 flush with the second end outer face 26, as shown in FIG. 5. A rotatable wheel 28 is used to enter the desired numeral in digital switch 24 which is displayed on a liquid crystal display unit (LCD) 30 connected to digital switch 24. As described in more detail herein below, digital switch 24 is electrically connected to the electrical circuit of device 10 and is normally closed until the appropriate digital code number is entered utilizing wheel 28. Digital switch 24 will open upon entering the correct digital code.

A lever 32 is operably mounted in central arm 14, and is biased so as to project outwardly from central arm 14. When a jogger grasps the device 10 around central arm 14, lever 32 will be depressed into central arm 14.

Figure 6:
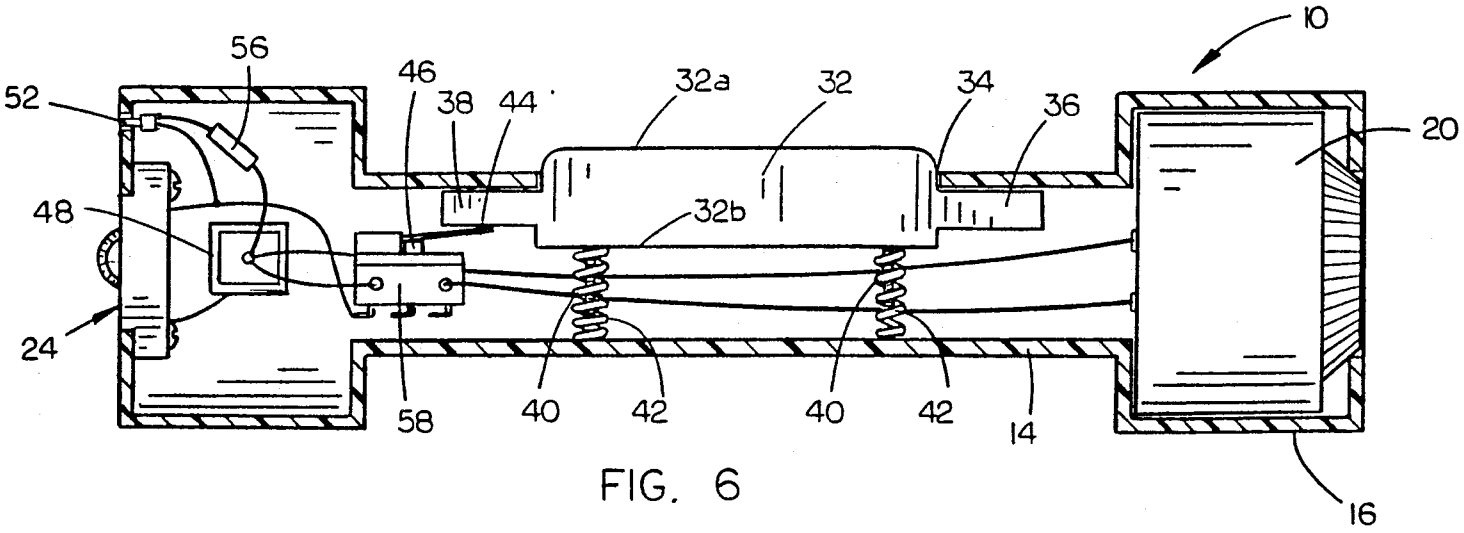
FIG. 6 is a sectional view taken at lines 6—6 in FIG. 3.

As shown in FIG. 6, lever 32 has an upwardly projecting end **32*a* extending through a slot 34 in central arm 14. A pair of flanges 36 and 38 project from opposing ends of lever 32 to prevent withdrawal of lever 32 through slot 34. A pair of pins 40 project downwardly from the lower end 32*b* of lever 32, a distance less than the distance between lower end 32*b* and the portion of central arm 14 opposite lever 32. A pair of coil springs 42 are mounted on pins 40 to bias upper end 32*a* of lever 32 and to slot 34**.

When flange 38 is in contact with a projecting arm 44 of a switch 46, arm 44 is pivotal between a first normally closed position and a second normally open position. Arm 44 is in the normally closed position when lever 32 is projecting outwardly from slot 34 to its fullest extent. Arm 44 is moved to the second position to open the switch, when lever 32 is biased downwardly against the bias of coil spring 42.

Figure 7:
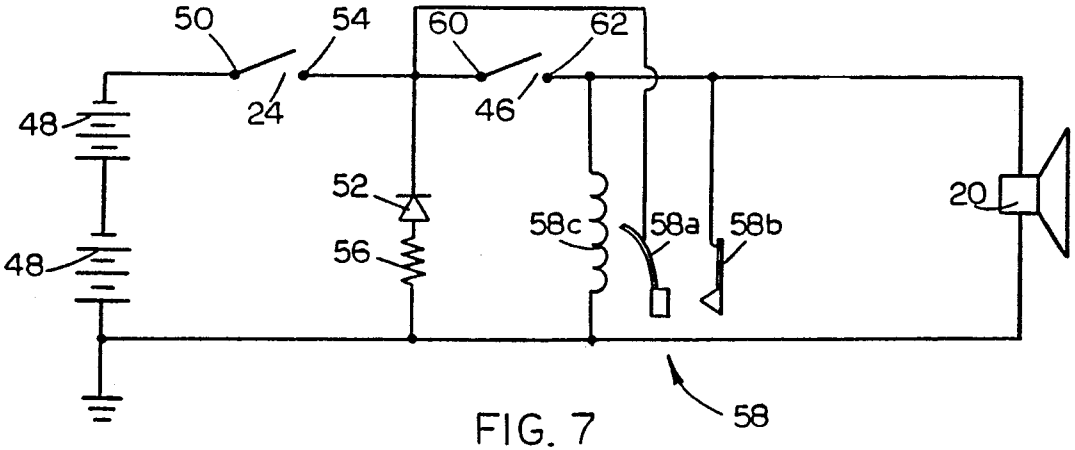
FIG. 7 is an electrical schematic of the invention.

Referring now to FIG. 7, the electrical circuit of the present invention is powered by one or more batteries 48 with one terminal connected to a terminal 50 of digital switch 24, and the opposite terminal connected to ground. A light emitting diode 52 is connected between the opposite terminal 54 of digital switch 24, through a resistor 56, and thence to ground. Thus, when switch 24 is closed, light emitting diode 52 will be activated to indicate that the personal protection device 10 is "armed".

One contact 58*a* of a relay 58 is connected to terminal 54 of digital switch 24. Switch 46 has one terminal 60 connected to terminal 54 of digital switch 24, with the opposite terminal 62 connected to: (A) one end of coil 58*c* of relay 58, (B) contact 58*b* of relay 58, and (C) speaker 20. The opposite end of coil 58*c*, and speaker 20, are both connected to ground.

In operation, a jogger will grip central arm 14 of the personal protection device 10, thereby depressing lever 32 and pivoting arm 44 so as to place switch 46 in an open condition. Digital switch 24 is then closed by rotating wheel 28 to change the numeral appearing on the LCD unit 30. As noted above, only one digital sequence will place switch 24 in the open position. Once switch 24 is closed, LED 52 will be energized so as to emit light and indicate that the personal protection device is "armed".

If the jogger is attacked or otherwise drops the device 10, lever 32 will be released and biased outwardly so as to close switch 46. The closing of switch 46 will energize both speaker 20 as well as coil 58*c* of relay 58. Thus, speaker 20 will produce a high decibel audible sound which is intended to scare the attacker away. The speaker 20 cannot be turned off by reopening switch 46, since coil 58*c* will cause contacts 58*a* and 58*b* to connect, thereby closing a second circuit which bypasses switch 46. In this way, once switch 46 has been closed, speaker 20 will be energized and cannot be turned off until switch 24 is opened. Since only the jogger will know the specific code number for opening digital switch 24, the attacker cannot easily or quickly turn off the personal protection device 10.

Whereas the invention has been shown and described in connection with the preferred embodiment thereof, it will be understood that many modifications, substitutions and additions may be made which are within the intended broad scope of the appended claims. For example, digital switch 24 may be replaced with a key and lock, such that the switch 24 is opened and closed by utilizing an appropriate key. Other types of selectively operable switches may also be utilized in place of digital switch 24.

There has therefore been shown and described an improved personal protection device which accomplishes at least all of the above stated objects.

I claim:

1. A personal protection device, comprising:

a hollow housing;

first switch means mounted in said housing operable between open and closed positions;

a lever operably mounted to said housing and connected to said first switch means, operable between a first position wherein said lever closes said first switch means, and a second position wherein said lever opens said first switch means;

electrical circuit means within said housing electrically connecting said first switch means to a speaker, a power source, and a second switch means;

said speaker mounted to said housing for providing a high decibel sound;

said second switch means mounted on said housing and operable between open and closed positions;

said power source mounted within said housing to power the electrical circuit and said speaker;

said electrical circuit means including means for energizing said speaker only upon the closing of both said first and second switch means, and for maintaining power to the speaker until said second switch means is opened;

said lever having an upper end projecting outwardly through a slot in said housing, and being operable inwardly and outwardly through said slot; and biasing means for biasing said lever outwardly, said lever located in the first position when biased outwardly, and in the second position when biased inwardly.

2. The device of claim 1, wherein said second switch means is a digital switch of the type which remains electrically closed until an appropriate code is entered to open the switch means.

3. The device of claim 1, further comprising visual indicator means electrically connected to said electrical circuit means and operable to indicate the open or closed condition of said second switch means.

4. The device of claim 1, wherein said electrical circuit means includes a relay electrically connected to be energized when both said first and second switch means are closed, and electrically connected to bypass said first switch means to provide power to said speaker after said relay is energized, whereby subsequent opening of said first switch means will not de-energize the speaker.

5. The device of claim 1, wherein said housing has a central arm portion which is generally cylindrical and has a diameter of about one inch, for grasping by a hand, said lever being located on said central arm portion for selective biasing by a hand.

6. A personal protection device, comprising:

a hollow housing having a central arm portion which is generally cylindrical and shaped for grasping by a hand;

first switch means mounted in said housing operable between open and closed positions;

a lever operably mounted to said housing and connected to said first switch means, operable between a first position wherein said lever closes said first switch means, and a second position wherein said lever opens said first switch means;

said lever being located on said central arm portion for selective biasing by a hand;

electrical circuit means within said housing, electrically connecting said first switch means to a speaker, a power source, and a second switch means which is selected from the group consisting of (i) a digital switch of the type which remains electrically closed until an appropriate code is entered to open the switch means and (ii) a keyed switch operable between open and closed positions only upon use of an appropriate key;

said electrical circuit means further includes a relay connected to be energized when both said first and second switch means are closed, and electrically connected to bypass said first switch means to provide power to said speaker after said relay is energized whereby subsequent opening of said first switch means will not de-energize the speaker;

visual indicator means electrically connected to said electrical circuit means and operable to indicate the open or closed condition of said second switch means;

said speaker mounted to said housing for providing a high decibel sound;

said second switch means mounted on said housing and operable between open and closed positions;

said power source mounted within said housing to power the electrical circuit and said speaker;

said electrical circuit means including means for energizing said speaker only upon the closing of both said first and second switch means, and for maintaining power to the speaker until said second switch means is opened;

said lever having an upper end projecting outwardly through a slot in said housing, and being operable inwardly and outwardly through said slot; and biasing means for biasing said lever outwardly, said lever located in the first position when biased outwardly, and in the second position when biased inwardly.

* * * * *